United States Patent [19]

Fischer

[11] Patent Number: 4,563,950

[45] Date of Patent: Jan. 14, 1986

[54] ROTARY PRINTING MACHINE WITH PAPER GUIDE

[75] Inventor: Hermann Fischer, Augsburg, Fed. Rep. of Germany

[73] Assignee: M.A.N.-Roland Druckmaschinen Aktiengesellschaft, Offenbach am Main, Fed. Rep. of Germany

[21] Appl. No.: 671,556

[22] Filed: Nov. 15, 1984

[30] Foreign Application Priority Data

Jan. 26, 1984 [DE] Fed. Rep. of Germany ..... 3402515

[51] Int. Cl.[4] ..... B41F 13/02

[52] U.S. Cl. ..... 101/178; 101/219; 101/417; 101/181; 226/172

[58] Field of Search ..... 226/170, 171, 172; 101/178, 417, 418, 219, 181, 183

[56] References Cited

U.S. PATENT DOCUMENTS

| | | | |
|---|---|---|---|
| 2,821,913 | 2/1958 | Johnson | 101/178 |
| 3,468,247 | 9/1969 | Vasilantone | 226/172 |
| 3,469,755 | 9/1969 | Rogers | 226/172 |
| 3,701,464 | 10/1972 | Crum | 101/181 |
| 3,819,445 | 6/1974 | Devries | 101/178 |
| 3,835,776 | 9/1974 | Weidman | 101/232 |
| 3,930,446 | 1/1976 | Crissy | 101/228 |
| 4,038,921 | 8/1977 | Harrison et al. | 101/232 |
| 4,145,039 | 3/1979 | Carlsson | 226/172 |
| 4,431,124 | 2/1984 | Campbell et al. | 226/170 |
| 4,474,342 | 10/1984 | Nater | 226/170 |

FOREIGN PATENT DOCUMENTS

| | | | |
|---|---|---|---|
| 499935 | 3/1951 | Belgium | 101/178 |
| 1038516 | 9/1958 | Fed. Rep. of Germany | 226/170 |

*Primary Examiner*—William Pieprz

*Attorney, Agent, or Firm*—Frishauf, Holtz, Goodman & Woodward

[57] ABSTRACT

To prevent smearing, ghost formation, or unsharp printing of offset printing machines, due to flutter, random oscillations or adhesion of a substrate to a blanket cylinder caused by adhesive characteristics of printing ink, an endless flexible guide element (9, 40, 48, 54, 68, 83, 84) is passed about the blanket cylinder and through the printing line with an impression cylinder, the guide element being, for example, a nylon thread, rope, or cable, or a thin flexible narrow web, guided, axially, with respect to the blanket cylinder by deflection rollers to locate the guide element at a position on the printed substrate which does not carry any printed copy. Preferably, the axial position of the guide rollers is adjustable, and at least one of the guide rollers is spring-loaded to adjust tension, which can be released for threading, or adjustment of the machine.

13 Claims, 8 Drawing Figures

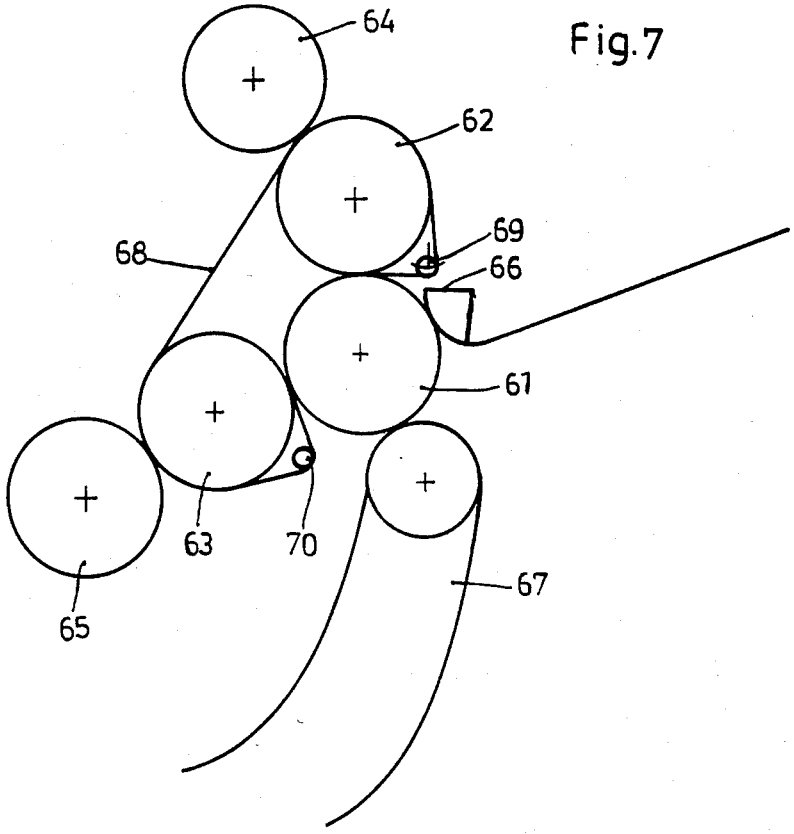
Fig. 7
Fig. 8
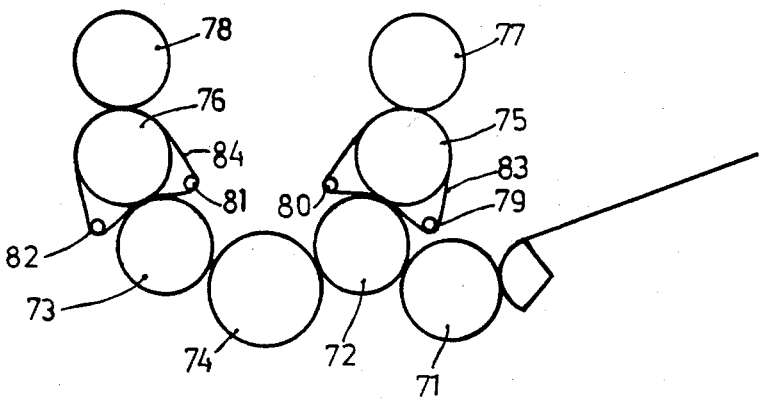

ROTARY PRINTING MACHINE WITH PAPER GUIDE

The present invention relates to a rotary printing machine, and more particularly to a rotary offset printing machine, having a plate cylinder and a rubber blanket cylinder, and a printing or impression cylinder which presses a substrate, on which printed subject matter is to appear, against the blanket cylinder.

Background

Ink used in printing, and particularly ink used in offset printing, in which a rubber blanket cylinder is used, against which printed substrates are pressed, is frequently sticky, and paper sheets or paper webs pressed against the blanket cylinder have a tendency to adhere thereagainst. As the printed sheet or web is pulled off from the blanket cylinder, a sheet or web has the tendency first to adhere over a portion of the circumference, and then to strip off suddenly. This results in oscillations of the substrate, flutter, or flicking in the case of sheets, particularly flicking of the trailing ends thereof; in other words, the path of the printed substrate is not accurately controlled at the pull-off position, just beyond the printing line between the blanket cylinder and the impression or counter cylinder which—in some installations—may itself be a blanket cylinder transferring printed subject matter. Loss of control of the substrate path may lead to smearing of the freshly printed image, or to ghosting thereof, that is, inaccurate or double-print images being transferred to the substrate.

THE INVENTION

It is an object to improve a printing machine, and more particularly a rotary offset printing machine having a rubber blanket cylinder, such that the path of the substrate web can be accurately controlled.

Briefly, flutter and random oscillation of the substrate, as it leaves the printing line, is prevented by providing an endless flexible guide element, for example in the form of a nylon thread or thin and narrow web, which is passed over a plurality of guide rollers as well as over the circumference of the printing cylinder, and positioned along a portion of the path of the substrate immediately adjacent the printing line. The guide element has a width which is up to, and preferably narrower than, the width of an unprinted zone on the substrate.

If printed subject matter is to be transferred to a substrate which is so arranged that a central unprinted strip, for example for a fold line, is left blank, the endless web or thread is positioned to run over the blanket cylinder in the region of this center fold line. More than one such thread or tape or belt may be used, for example one to contact the sheet at a center fold line, and one more, each, adjacent the edges, in the region of lateral margins of the substrate.

DRAWINGS

FIG. 7 is another embodiment in which the invention is applied to yet another type of printing system; and FIG. 8 is a schematic side view of yet another type of printing machine to which the present invention is applied.

DETAILED DESCRIPTION

Figure 1:
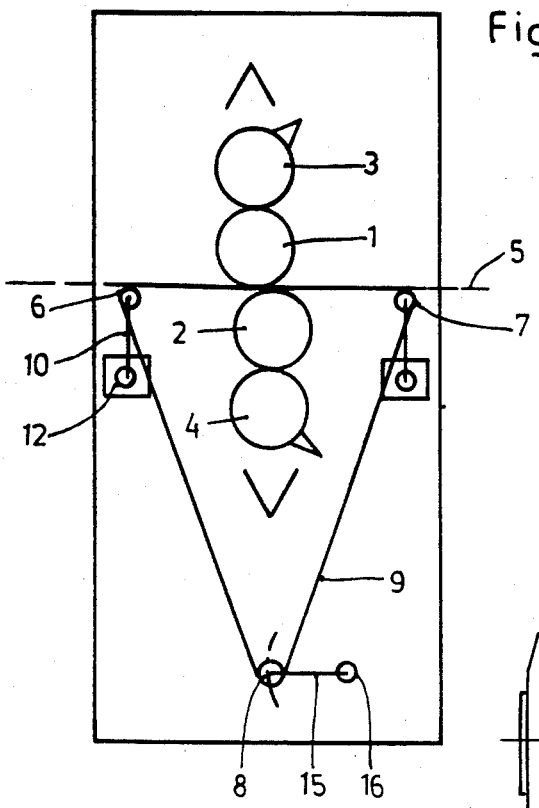
FIG. 1 is a schematic side view of a printing station with the arrangement of the present invention.

As seen in FIG. 1, two blanket cylinders 1, 2 of an offset rotary printing machine are in engagement with two plate cylinders 3, 4, respectively, which each have an inker and a damper associated therewith, shown only schematically. The arrangement is entirely conventional. The printing system of FIG. 1 is used for prime and verso printing, that is, for perfect printing; the printing station or system of FIG. 1 can be connected with other similar printing stations, for example for multi-color offset rotary printing.

The path of a substrate web is shown by the broken line 5. Rotary offset printing machines utilize ink which is somewhat sticky, and it may well happen that a substrate web which should follow the theoretical path of the broken line 5 will, in fact, follow along the circumference of one or the other of the blanket cylinders and then strip off or tear off, at a position which is not in the path 5. This tendency of the web to adhere to the blanket cylinder pulls the substrate web from its intended path 5. Upon stripping off, or pulling off, the web will be stressed and, additionally, will start to oscillate or flutter. Flutter of the web can also be caused by the cylinders as the web passes over the grooves formed in the cylinders to attach the rubber blankets. If the web is oscillating or undulating, or subject to flutter, it will no longer operate in the intended path 5, and thus will not run precisely towards the blanket cylinder of a next adjacent printing station—not shown in FIG. 1. Rather, a substrate web may engage the next blanket cylinder already in advance of the printing line and this may, thus, result in transfer of ink thereto at undesired locations which, as a consequence, will have ghosts, double-print, or a fuzzy and unsharp print image as the result, after passing through the blanket cylinder.

In accordance with the present invention, an endless flexible guide element 9 is passed through the printing line and over the blanket cylinder 2. The endless flexible guide element 9, for example, is a nylon thread or thin rope or string or cable, or a thin web or belt, the width of which is narrower than a strip on the substrate web which does not carry printing information, for example the region of a centerfold, an external margin, or the like. The guide element 9 is guided in its path, precisely, by three rollers 6, 7, 8 which, likewise, are thin, and so arranged that they will not engage freshly printed subject matter. Smearing of the freshly printed ink, thus, is effectively avoided.

Figure 2:
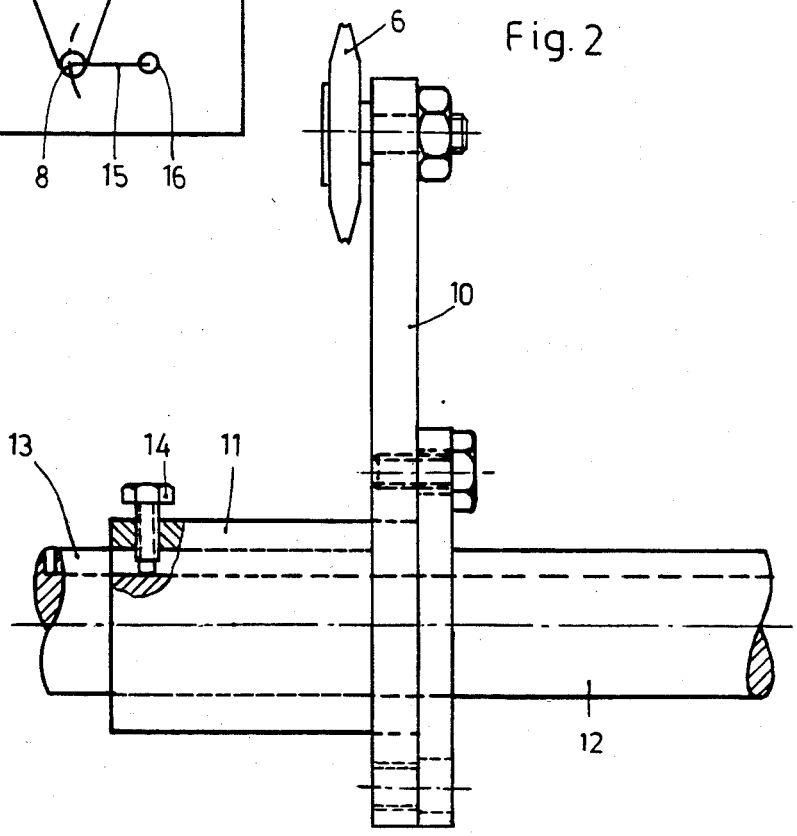
FIG. 2 is a detail side view, partly in section, of the apparatus of FIG. 1.

One of the guide rollers 6, and its attachment, is shown in FIG. 2. Guide roller 6 is rotatably secured to a lever 10 which is connected to a flange, integral with a sleeve or bushing 11. The sleeve 11 is axially slidable on a shaft 12 which is located between side walls—not shown in FIG. 2—of the printing machine. The shaft 12 is formed with an axially extending groove 13, engageable by a set screw 14 passing through the sleeve 11. By axially sliding the lever 10 and the bushing 11, the guide roller 6 which, preferably, has a narrow V-shaped groove, and is hardly wider than the element 9—see FIG. 2—can be located at a suitable position in which the flexible endless guide element 9 will be positioned in the range of a center strip or some other region of the substrate web which does not carry printed information. The set screw 14 then is used to tighten the sleeve 11 in position, and hence positively locate the guide roller 6. Guide roller 7 can be similarly supported.

The lower guide roller 8 is secured to a lever 15 which is freely rotatable about a shaft 16, secured between the side walls of the machine. The weight of the guide roller 8 provides for tension on the endless guide element 9. If the guide roller 8 should be of insufficient weight, a suitable tensioning spring or an additional tensioning weight can be used, to provide the necessary tension for the endless element 9 so that it will run true, and without oscillation or flutter between the guide rollers 6, 7, even if engaged by fluttering portions of the web being passed between the blanket cylinders 1, 2.

Figure 3:
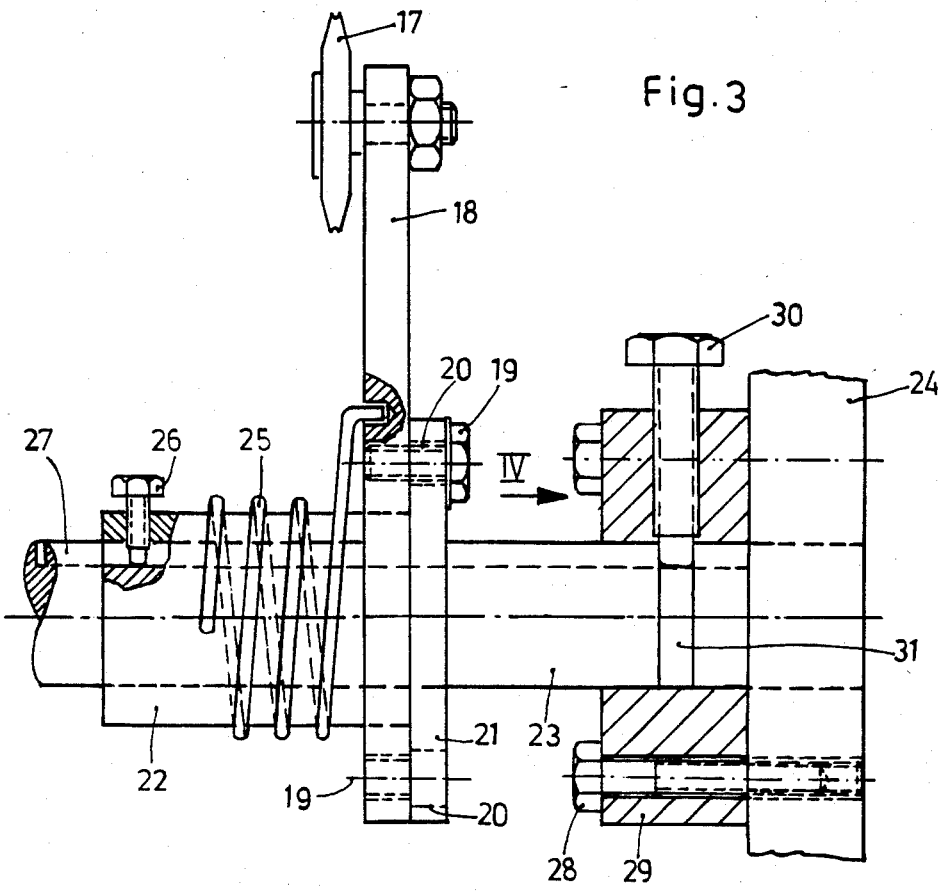
FIG. 3 is a view similar to FIG. 2, and illustrating another embodiment.

Various other constructions for one or all of the guide rollers may be used. FIG. 3 illustrates another arrangement in which a guide roller 17, for example suitable to replace guide roller 6, or 7, is shown, freely rotatable about a shaft secured to a lever 18. The lever 18 has two screws 19 attached thereto, each of which passes through a slot 20 in a flange 21 of a sleeve or bushing 22. The sleeve 22 is slidably placed on a shaft 23 which, in turn, is located between side walls of the printing machine, of which only one is shown at 24. The slots 20 extend about the shaft 23 at the same radius, so that the lever 18 may be pivoted, to a limited extent, with respect to the bushing 22. A spring 25 is located between the lever 18 and the bushing or sleeve 22, which retains the lever 18, resiliently, and tensions the endless guide element 9, in its operating position or path. The axial position of the sleeve 22 can be determined by a set screw 26 which engages in a groove 27, cut into the shaft 23, and thus axially positioning the lever 18, and hence the roller 17.

Figure 4:
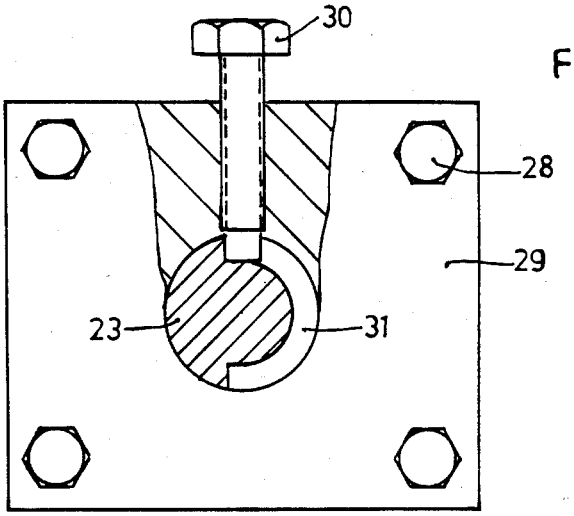
FIG. 4 is a fragmentary end view, partly in section, with parts broken away, taken in the direction of view of arrow IV of FIG. 3.

As shown in FIG. 4, the shaft 23, preferably, is held in position at the side wall 24 by a plate 29, attached to the side wall 24 by screws 28. The plate 29 has a set screw 30 screwed through a suitable opening thereof. The lower end of the set screw 30 engages into a groove 31, extending about a portion of the circumference of the shaft 23. This permits positioning of the angle of the shaft 23 with respect to the side wall 24. After loosening of the set screw 30, the shaft can be rotated about an angle which corresponds to a desired position, up to the length of the slit 31. The roller 17 will follow this rotation. This arrangement permits release of tension on the endless element 9, which is desirable for threading or feeding paper sheets or webs into the printing machine, that is, to feed a test sheet or a web into the printing machine with the guide element 9 relaxed.

Figure 5:
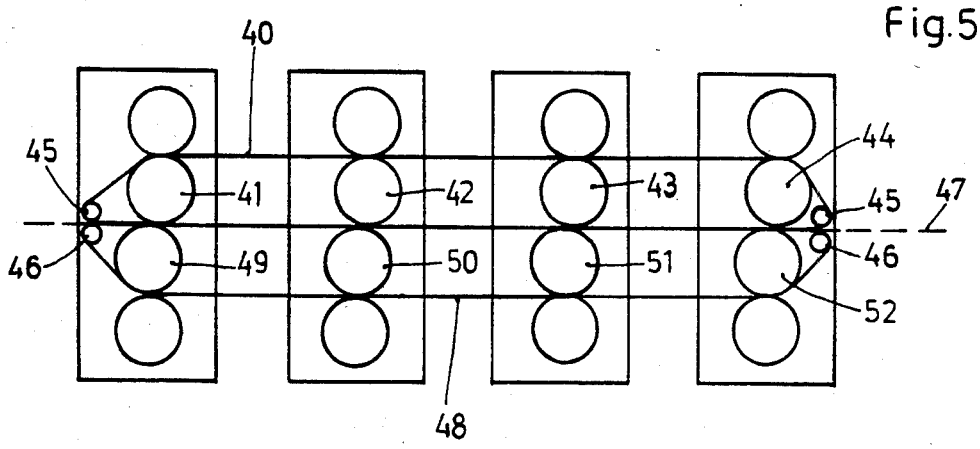
FIG. 5 is a schematic side view of another embodiment of the present invention.

FIG. 5 illustrates a rotary offset printing machine for perfect printing, having four printing station. An upper flexible guide element 40 is guided by guide rollers 45 about the blanket cylinders 41, 42, 43, 44. The guide element 40 thus provides an upper limit or upper guide path for the desired path 47 of a substrate to be fed through the printing stations. A further guide element 48 is provided, looped about the lower blanket cylinders 49–52, and guided in its path by two further guide rollers 46. The guide element 48 also defines the path 47, by providing a lower limit therefor.

In the arrangement of FIG. 5, the guide element 40 is guided between the blanket cylinders as well as the associated plate cylinders. In such an arrangement, the blanket cylinders are preferably formed with a guide groove or guide slot to receive the respective guide element 40, 48. Of course, a plurality of guide elements, axially staggered, may be placed in paths similar to those of guide elements 40, 48 if the substrate on which printing is to be carried out has a plurality of continuous strips which do not carry printed subject matter.

The endless guide elements 40, 48 insure appropriate run of the substrate web through all the printing stations, that is, a run, or path free from vibrations, oscillations, or flutter. The additional requirement for parts and structures is low, and less than if each one of the blanket cylinders has its own guide element associated therewith.

Figure 6:
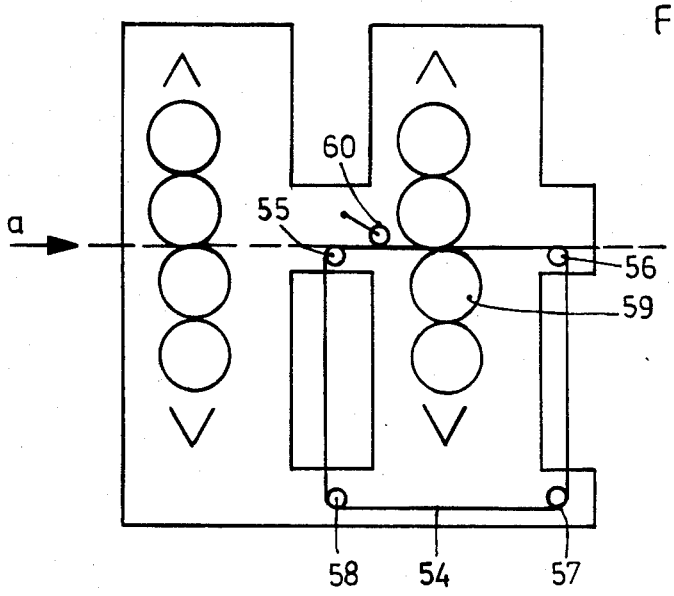
FIG. 6 is a schematic side view of yet another embodiment illustrating another type of printing machine.

FIG. 6 illustrates a rotary offset printing machine with two printing stations for perfect printing. In this arrangement, only the downstream — in the direction of movement of the substrate web, indicated by the arrow a — station has a guide element 54 associated therewith. The guide element 54 is located beneath the path of the substrate web, guided over rollers 55–58 and the blanket cylinder 59. An additional engagement roller 60 is provided in order to insure that the substrate web is properly fed to the second printing station. The guide roller 60 preferably is spring-loaded and located in the axial position of the endless guide element 64 to guide the substrate web against the guide element 54 before it enters the second printing station.

The present invention is applicable to continuous web as well to sheet-fed printing machines. In sheet-fed printing machines, flicking of the trailing ends of sheets, as they leave printing stations, may cause problems, and the use of a guide element to prevent such flicking is particularly desirable in connection therewith.

FIG. 7 illustrates a five-cylinder sheet printing machine having an impression cylinder 61, two blanket cylinders 62, 63, and associated plate cylinders 54, 65. Inkers and dampers have been omitted from the illustrations of FIGS. 7 and 8 — as they have been from FIGS. 5 and 6 — for simplicity of the drawings, and may be of any suitable and conventional construction. Sheets are fed to the printing station by a sheet-feeding apparatus shown schematically at 66, including a feed gripper; the printed copy is removed by a transport chain 67.

The sheet is supplied by the feed grippers 66 to suitable grippers on the impression cylinder 61, guided thereby to the impression lines with the blanket cylinders 62, 63 and then supplied to the transport chain 67.

In accordance with a feature of the invention, a flexible guide element 68 is provided which is guided in its path by the blanket cylinders 62, 63, the impression cylinder 61, and two additional deflection rollers 69, 70. The portion of the guide element 68 between the deflection roller 69 and the impression cylinder 61 prevents premature engagement of portions of the sheet on the blanket cylinder 62 which sheet, in this part of its path, is held only at its leading edge by grippers on the impression cylinder 61. The sheet has a tendency, particularly after transfer to the grippers of the impression cylinder 61, to vibrate or flutter; this is particularly so in the region of and at the trailing edge of the sheet. Similarly, the portion of the guide element 68 between the blanket cylinder 63 and the deflection roller 70, insures that a sheet, after its rear edge leaves the printing line, that is, the gap between the impression cylinder 61 and the blanket cylinder 63, will not adhere to the blanket cylinder 63, or be subject to flutter or flicking and, thereby, for example, engage elements of the guide structure for the transport chain 67.

FIG. 8 illustrates — in highly schematic representation — a two-color sheet printing machine with a supply drum 71, a first printing station with an impression cylinder 72, blanket cylinder 75 and plate cylinder 77. A transport drum 74 is located downstream of the first printing station, to supply sheets to a second printing station. The second printing station has an impression cylinder 13, a blanket cylinder 76, and a plate cylinder 78. Removal of the sheets may, for example, be by a transport chain similar to chain 67, FIG. 7, and omitted from FIG. 8 for clarity.

In accordance with a feature of the invention, a first guide element 83 is guided about the blanket cylinder 75 by two deflection rollers 79, 80; similarly, a further guide element 84 is looped about the blanket cylinder 76, guided by guide rollers 81, 82.

The guide elements 83, 84, which may be similar to guide element 9, described above with respect to FIG. 1, insure that a sheet fed to the respective rubber blanket cylinder cannot engage the blanket cylinder prematurely. This is insured by the portions of the guide elements 83, 84, respectively, which extend between the guide roller 79 and blanket cylinder 75 on the one hand, and guide roller 81 and blanket cylinder 76 on the other. Those portions of the guide elements which are located between the first blanket cylinder 75 and the roller 80 and, respectively, the second blanket cylinder 76 and the roller 82, further insure that the sheet, after leaving the impression or printing line, will remain on the impression cylinder and not tend to stick or adhere to the blanket cylinder, thus flicking off or fluttering or oscillating.

All the embodiments may use a plurality of axially spaced guide elements, provided the copy contains zones which do not carry printed information. Various changes and modifications may be made, and features described in connection with any one of the embodiments may be used with any of the others, within the scope of the inventive concept.

I claim:

1. Rotary offset printing machine for printing on a flexible substrate, subject to flutter, and random oscillations, having at least one blanket cylinder (2, 41–44, 49–52; 59; 62,63; 75,76);

at least one plate cylinder (3,4,64,65,77,78) associated with each blanket cylinder; and at least one impression cylinder (61,72,73) positioned for engagement along a nip line of contact against a respective rubber blanket cylinder, with the substrate interposed and supported thereat, to define a printing line with the respective rubber blanket cylinder, comprising, in accordance with the invention, means to suppress flutter and random movement of the substrate transverse to an intended substrate path (5,47) located between, and diverging from the respective surface of said impression (61,72,73) and blanket (63,75,76) cylinders downstream of said nip line of contact, including a thin, endless, flexible guide element (9, 40, 48, 54, 68, 83, 84) passing, along and on a portion of a major surface of said substrate, through said nip between said blanket and impression cylinders and serving to increase support for the substrate adjacent the print line, said guide element having a width which is up to the width of an unprinted zone of the substrate; and a plurality of guide rollers (6, 7, 8; 17; 45, 46; 55, 56, 57, 58; 69, 70; 80, 81, 82) guiding the endless guide element about a respective blanket cylinder and along a portion of the path (5, 47) of the substrate immediately adjacent the printing line.

2. Machine according to claim 1, wherein the guide element is filamentary element.

3. Machine according to claim 1, wherein the guide element is a thin, narrow web or belt.

4. Machine according to claim 1, wherein at least those guide rollers adjacent a blanket cylinder are secured to a frame of the machine for axial adjustment to place the guide rollers, and hence the endless flexible guide element, guided thereby, on the unprinted zone of the substrate.

5. Machine according to claim 1, wherein at least one of the guide rollers guiding the endless flexible guide elements is movable between an engaging and a releasing position with respect to the flexible guide element to permit tensioning of the flexible guide element, in operation of the machine, for guiding the substrate, and release of tension of the flexible guide element during non-production printing of the machine and for threading of a substrate through the machine.

6. Machine according to claim 1, wherein at least one of the guide rollers exerts a tensioning force on the endless flexible guide element.

7. Machine according to claim 1, wherein at least one of the guide rollers is spring-loaded (25) to exert a tensioning force on the endless flexible guide element.

8. Machine according to claim 1, wherein the substrate comprises a substrate web, guided in a straight line printing path through a plurality of printing stations;

and wherein, in accordance with the invention, at least one guide element (54) is located to loop about the blanket cylinder (59) of the last printing station — in the direction of travel of the web.

9. Machine according to claim 1, wherein a plurality of printing station, each having a blanket cylinder, are provided;

and wherein, in accordance with the invention, the flexible endless guide element (40, 48) extends along the path of the substrate about a plurality of blanket cylinders (41–44; 59–52).

10. Machine according to claim 1, further including an engagement roller (60) positioned opposite the endless flexible guide element (54) and located for passage of the substrate between the engagement roller (60) and the endless guide element and to press the substrate against the endless guide element (54).

11. Machine according to claim 1, wherein the impression cylinder comprises a blanket cylinder for simultaneous perfect printing on the substrate;

and wherein each one of the blanket cylinders (41, 49; 42, 50; 53, 51; 44, 52) has a guide element (40, 48) passed thereover.

12. Machine according to claim 1, wherein the blanket cylinder which has a guide element passing thereover is formed with a depression to receive the endless flexible guide element therein.

13. Machine according to claim 1, wherein one guide roller, each, is located at opposite sides of the printing line, and guiding said flexible endless guide element between the impression cylinder and the respective blanket cylinder, the portion of the endless guide element ahead — in the direction of passage of the substrate — of the printing line guiding the substrate to the printing line and preventing premature engagement of the substrate with the blanket cylinder, and the guide roller downstream of the printing line guiding said substrate away from the blanket cylinder and inhibiting flutter or flicker of the substrate due to adhesive characteristics of printing ink on the blanket cylinder.

* * * * *